US006032291A

United States Patent [19]

Asenguah et al.

[11] Patent Number: 6,032,291

[45] Date of Patent: Mar. 7, 2000

[54] SOLAR POWERED HEAD COOLING DEVICE

[76] Inventors: Augustus Asenguah; Taiwo Akinsanya, both of 820 W. Belle Plaine Ave., no. 405, Chicago, Ill. 60613

[21] Appl. No.: 09/222,479

[22] Filed: Dec. 29, 1998

[51] Int. Cl.[7] ..... A42B 1/24

[52] U.S. Cl. ..... 2/171.3; 2/7; 2/209.13; 2/906

[58] Field of Search ..... 2/7, 171.3, 209.13, 2/906, DIG. 1

[56] References Cited

U.S. PATENT DOCUMENTS

| | | |
|---|---|---|
| 4,680,815 | 7/1987 | Hirsch et al. . |
| 4,893,356 | 1/1990 | Waters . |
| 5,085,231 | 2/1992 | Johnson . |
| 5,410,746 | 4/1995 | Gelber . |
| 5,425,620 | 6/1995 | Stroud . |
| 5,438,698 | 8/1995 | Burton et al. . |

*Primary Examiner*—Diana Oleksa
*Attorney, Agent, or Firm*—Michael I. Kroll

[57] ABSTRACT

The present invention discloses an apparatus 10 for providing solar powered air circulation to the face and upper body of the user. A means for mounting photoelectric cells 16 to the apex of the top of a hat 12 is provided which cells 16 are connected by wire 24 to a directionally selective fan 14 which is located under the brim 18 of the hat 12. The fan 14 receives air transmitted through a conduit 20 under the brim of the hat 12 which has its air inlets 22 on the lateral edges of the brim 18 of the hat 12. The fan 14 is also provided with a horizontally movable axle 26 means whereby it is partially rotatable in the horizontal axis to selectively distribute the air. An alternative embodiment 30 is provided wherein the components of the present invention are assembled onto a modular semi-flexible frame 30 which can be attached to an existing favorite cap 12 by means of hook and loop material 36 thereby providing a portable cooling unit which can be easily attached to various hats.

4 Claims, 7 Drawing Sheets

SOLAR POWERED HEAD COOLING DEVICE

BACKGROUND OF THE INVENTION

1. Field of the Invention

The present invention relates generally to solar powered headwear and, more particularly, to a cap having a solar powered electrical fan mounted to the underside of the hat brim along with a length of conduit wherein the fan is directional whereby the flow of air can be directionally oriented to offer the greatest cooling advantage to the wearer.

2. Description of the Prior Art

There are numerous solar powered headwear designed to provide for cooling of the head and face. Typical of these patents is U.S. Pat. No. 4,680,815 issued to Hirsch et al on Jul. 21, 1987.

Another solar powered headwear was issued to Waters on Jan. 16, 1990 as U.S. Pat. No. 4,893,356. Yet another U.S. Pat. No. 5,085,231 was issued to Johnson on Feb. 4, 1992. Still yet another U.S. Pat. No. 5,410,746 was issued to Gelber on Apr. 25, 1995. Another U.S. Pat. No. 5,425,620 was issued to Stroud on Jun. 20, 1995 and yet another was issued to Burton et al on Aug. 1, 1995 as U.S. Pat. No. 5,438,698.

U.S. Pat. No. 4,680,815

Inventor: Hirsch et al.

Issued: Jul. 21, 1987

The present invention includes a self-contained personal cooling device. It is a one piece modular component which is pre-wired and interchangeable between different hats. The components of the modular unit are employed in the unit to effect total body cooling by evaporation and forced convection. The unit is powered by photo-voltaic energy. The cooling effect of this modular unit is maximized by incorporating air vent slots adjacent to the fan motor assembly to increase the force of air delivery.

U.S. Pat. No. 4,893,356

Inventor: William A. Waters

Issued: Jan. 16, 1990

Headwear, including all forms of caps, hats, hard hats and visor type caps to include a switchable power module capable of converting an electric motor driven air moving means from battery power to solar power wherein the solar power panel is removable.

U.S. Pat. No. 5,085,231

Inventor: Ronald A. Johnson

Issued: Feb. 4, 1992

A head-mounted, hat-like device includes components for guiding a stream of air flowing in a direction frontwardly of the face of the user and filter components for filtering the stream of air. The air flow guiding components include a fan fixedly mounted to a housing, a directional member mounted to the visor portion of the housing for directing air frontwardly of the person's face and a conduit for interconnecting the directional component and the fan device. The fan device draws ambient air including smoke and other by-products of burning tobacco through the directional component and along the conduit to be discharged by the fan device through a conventional tobacco by-product filter component, thereby cleansing the stream of air before it is released to the air space above a person.

U.S. Pat. No. 5,410,746

Inventor: Hugh T. Gelber

Issued: Apr. 25, 1995

Headgear, such as a cap having a crown, a brim and an internal sweatband or flap, is combined with an electronic receiving device, such as a radio, which is connected to the inner surface of the flap by a first double sided adhesive strip. The first strip, in turn, is adhesively secured to a backing element mechanically attached to the flap. A battery holder is similarly mounted to the flap on the other side of the brim by a second double sided adhesive strip and a second backing element. Earphones are connected to the radio by suitable wires with the wires for the earphones on the opposite side of the radio, along with wires connecting the battery holder to the radio, being secured to the inner surface of the flap adjacent the brim by a third double sided adhesive strip. Preferably, when an electronic receiving means if an AM/FM radio, an antenna is provided.

U.S. Pat. No. 5,425,620

Inventor: Kevin J. Stroud

Issued: Jun. 20, 1995

An electrically driven fan mounted on the brim or crown of a cap or other head gear is manufactured from plastic, and readily mountable on the head gear without the need for special tools or skills. Dry cell batteries are mounted in the crown of the hat and the impeller of the fan unit acts within a recess within the fan unit to pull air downwardly across the face of the user.

U.S. Pat. No. 5,438,698

Inventor: Burton, et al.

Issued: Aug. 1, 1995

A wearable audio reception device includes an elongated flexible enclosure removably attachable to an article of clothing and the radio in turn being removably attachable to the flexible enclosure.

While these headwear may be suitable for the purposes for which they were designed, they would not be as suitable for the purposes of the present invention, as hereinafter described.

SUMMARY OF THE INVENTION

The present invention discloses a means of providing solar powered air circulation to the face and upper body of the user. A means for mounting photoelectric cells to the apex of the top of a hat is provided which cells are connected by wire to a directionally selective fan which is located under the brim of the hat. The fan receives air transmitted through a conduit under the brim of the hat which has its air inlets on the lateral edges of the brim of the hat. The fan is also provided with a horizontally movable axle means whereby it is partially rotatable in the horizontal axis to selectively distribute the air. An alternative embodiment is provided wherein the components of the present invention are assembled onto a modular semi-flexible frame which can be attached to an existing favorite cap by means of hook and loop material thereby providing a portable cooling unit which can be easily attached to various hats.

A primary object of the present invention is to provide means for directing an air flow around the head area.

Another object of the present invention is to provide an apparatus with means for directing an air flow around the head area using photo voltaic cells, a fan and conduit.

Yet another object of the present invention is to provide a cap which incorporated a fan located on the brim of the hat with conduit for conducting an air flow to said fan and means for powering said fan by photo voltaic cells.

Still yet another object of the present invention is to provide a means for selectably directing an air flow around the head area Additional objects of the present invention will appear as the description proceeds.

The present invention overcomes the shortcomings of the prior art by providing an apparatus which can be incorporated into a new or existing cap wherein an air flow can be selectably directed around the head area by means of a fan using a conduit which can cause an increase in cooling area by providing intake ports located along the outer edges of the conduit and powering said fan by means of photo voltaic cells.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

Figure 4:
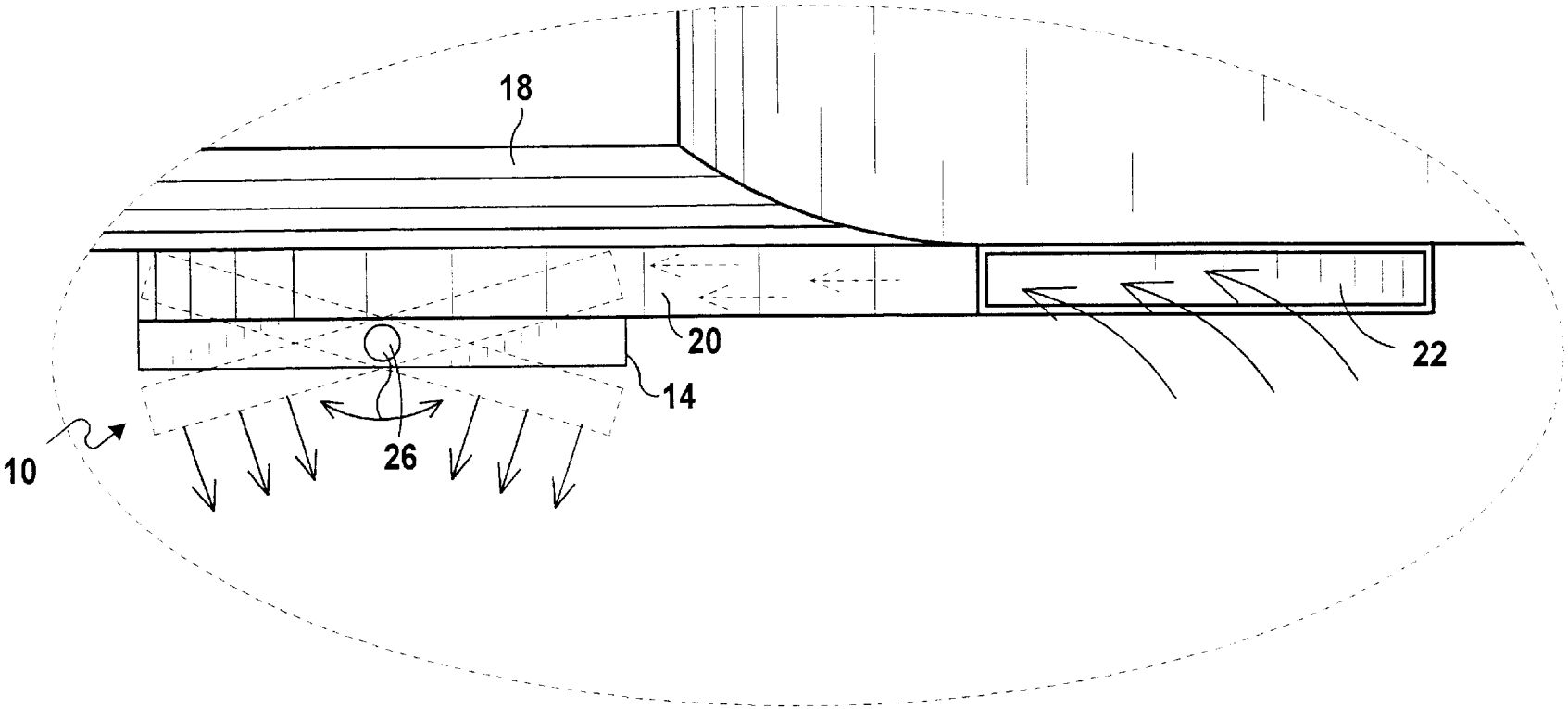

FIG. 4 is an exploded view of the apparatus for directing an air flow to the facial area of the head. Shown is a length of conduit which brings an amount of air from the side of the brim and delivers said air by means of an impeller to the front of the head wherein it is selectably directed. This allows the wearer to direct air which contains an undesirable amount of airborne particles such as dust and dirt away from the face and uses said air flow to create a screen to prevent said airborne particles from entering the frontal area of the head. The conduit acts in concert with the fan to keep any airborne particles away from the eyes of the wearer.

Figure 5:
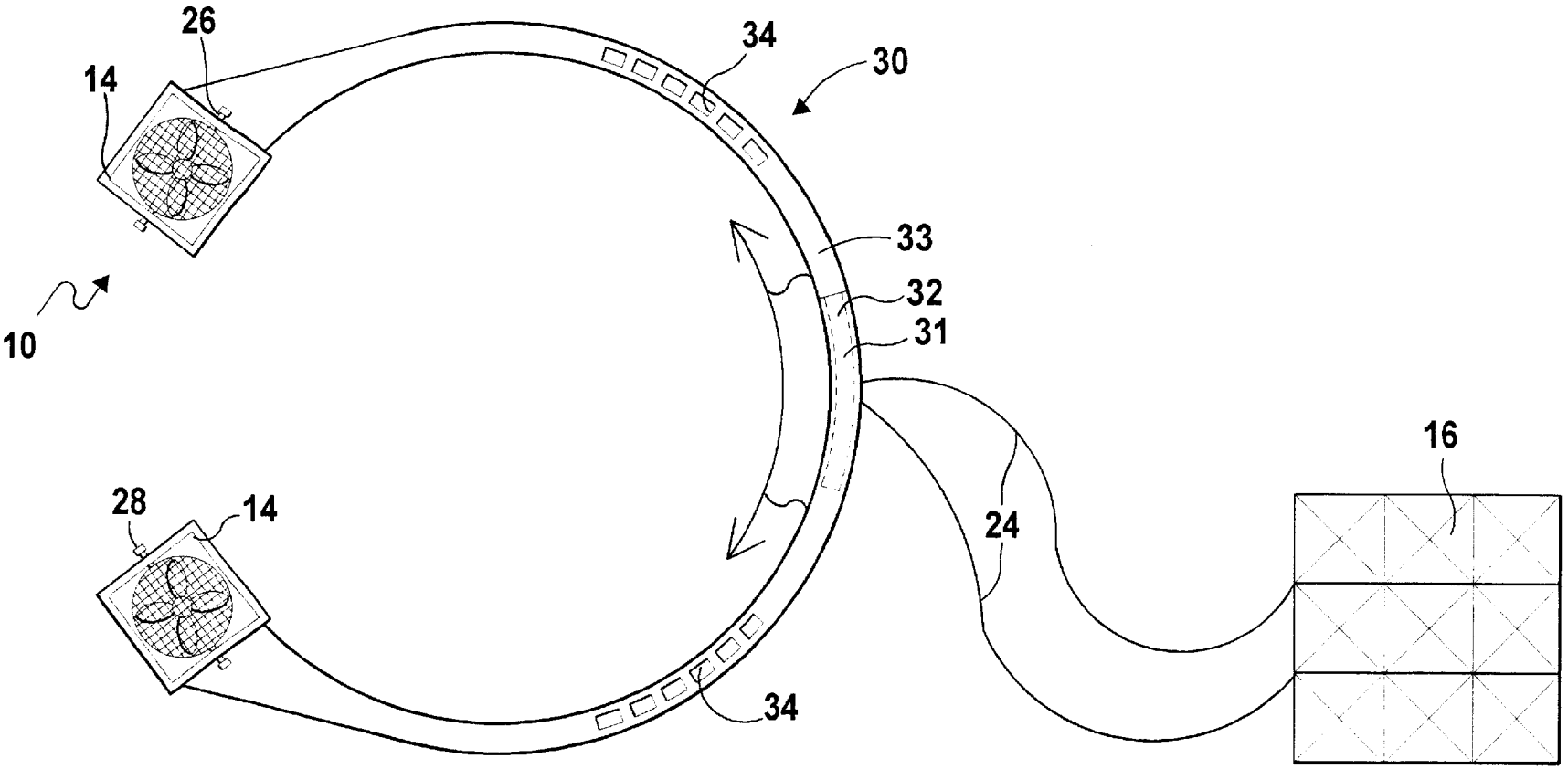

FIG. 5 is a bottom view of the alternate embodiment of the present invention wherein the components of the cooling apparatus are contained within an apparatus which can be attached to any favorite cap without modification of the cap and the apparatus has means of adjustment wherein said apparatus will be adjusted to fit the hat size.

Figure 6:
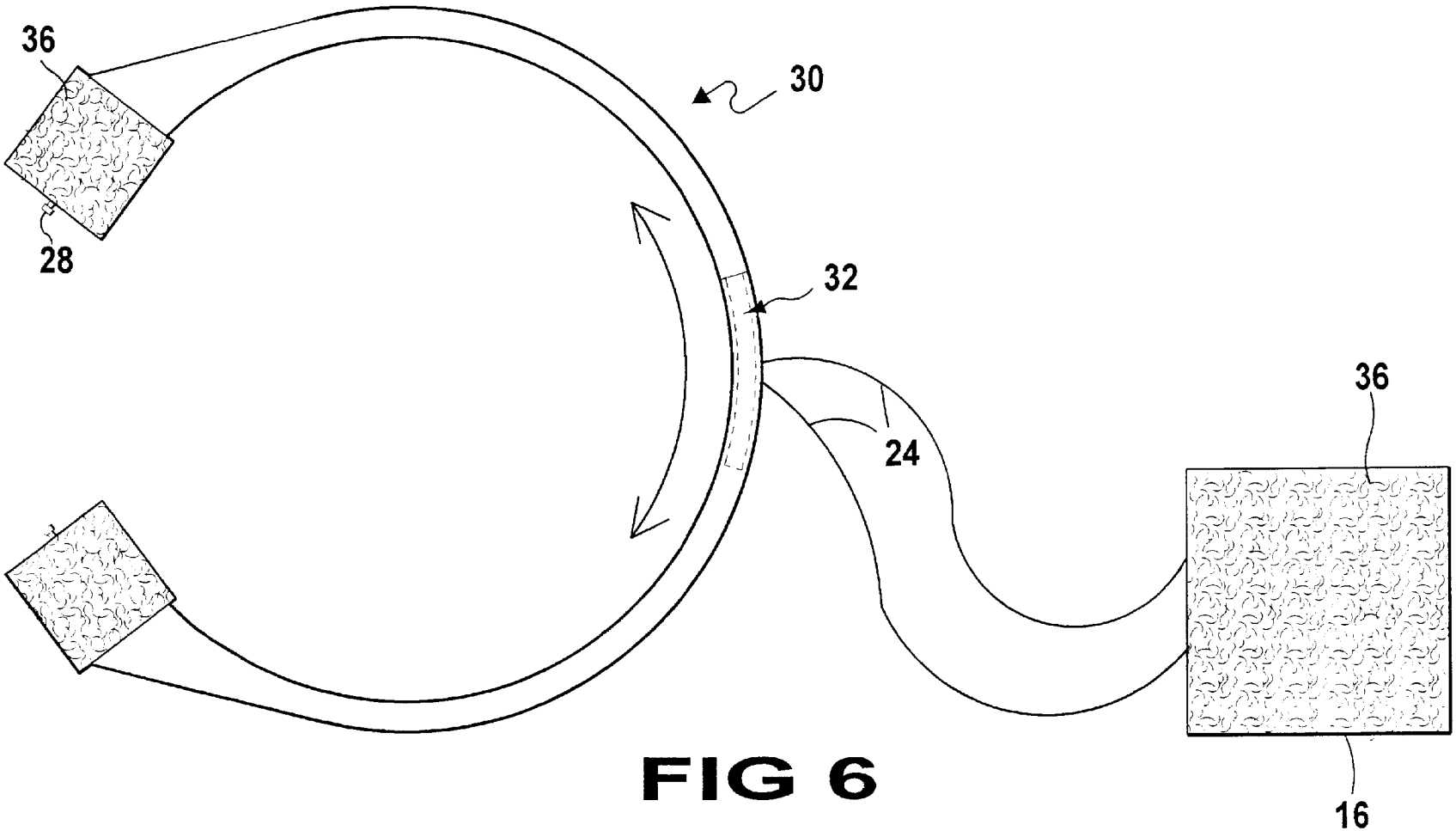

FIG. 6 is a top plan view of the alternate embodiment of the present invention showing an amount of hook and loop which can be used to attach the alternate embodiment to the brim of the cap.

Figure 7:
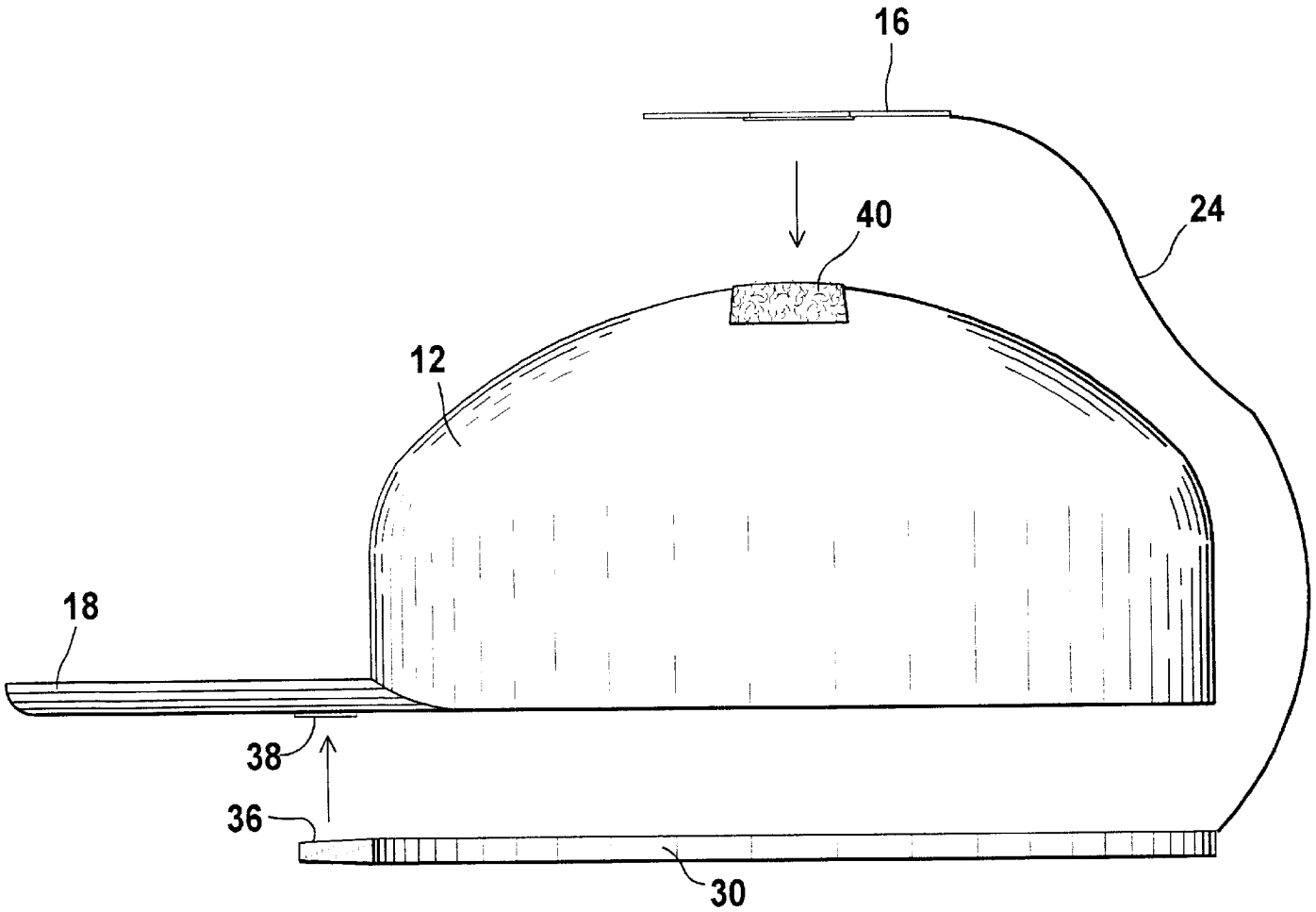

FIG. 7 is a side perspective view of a cap showing the means for attaching the cooling apparatus to an existing cap by attaching an amount of hook and loop material to the cap which will hold the alternate embodiment to the cap.

DESCRIPTION OF THE PREFERRED EMBODIMENT(S)

Turning now descriptively to the drawings, in which similar reference characters denote similar elements throughout the several views, FIGS. 1 through 7 illustrate the present invention 10 as a device for cooling headgear 12. With regard to the reference numerals used, the following numbering is used throughout the various drawing figures.

Figure 1:
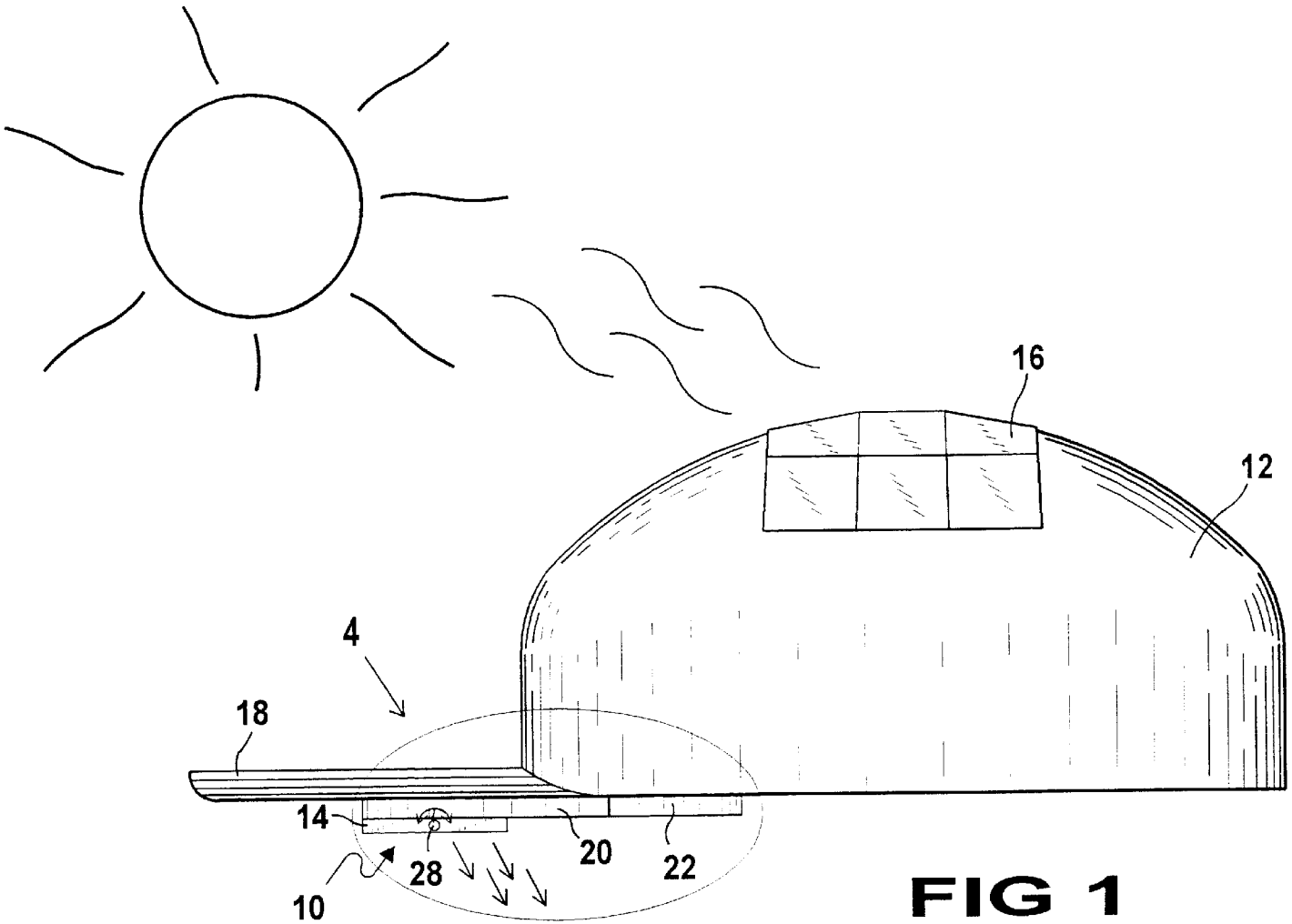
FIG. 1 is a perspective view of the present invention wherein a cap having a fan for directing an air flow around the head area and mounted within conduit on the brim and powered by a number of photo voltaic cells which are arrayed in such a manner that a portion thereof will be continuously facing the sun regardless of the declination of the sun.

10 present invention
12 hat
14 fan housing
15 fan blades
16 photoelectric cells
17 fan screen
18 brim
20 conduit
22 inlet of conduit
24 wires
26 axle of fan
28 control knobs
30 modular frame
31 male adjustment
32 adjustable frame
33 female adjustment
34 air inlet
36 hook and loop material
38 hook and loop material
40 hook and loop material Turning to FIG. 1, therein is shown a side perspective view of the present invention generally shown at 10, which includes a cap 12 having a fan housing 14 having a control knob 28 on its mounting axle for directing airflow about the head of the user. Shown therein is the cap 12 having multiple photoelectric cells 16 mounted on or near the apex of its top which gather sunlight and generate electricity which is used to operate the fan 14. It can be seen that the brim 18 has the fan 14 mounted on its underside wherein the fan has mounting means onto and in communication with a conduit 20 also having mounting means to the underside of the brim 18 which brings in fresh air for the fan to transmit to the head area of the user. The inlet ports 22 to the conduit bring the fresh air into the conduit 20 for transmission to the face area of the user. The photoelectric cells 16 are arranged in such a manner that a portion of the cells will be continuously facing the sun regardless of the declination of the sun so as to constantly generate electricity to operate the fan 14.

Figure 2:
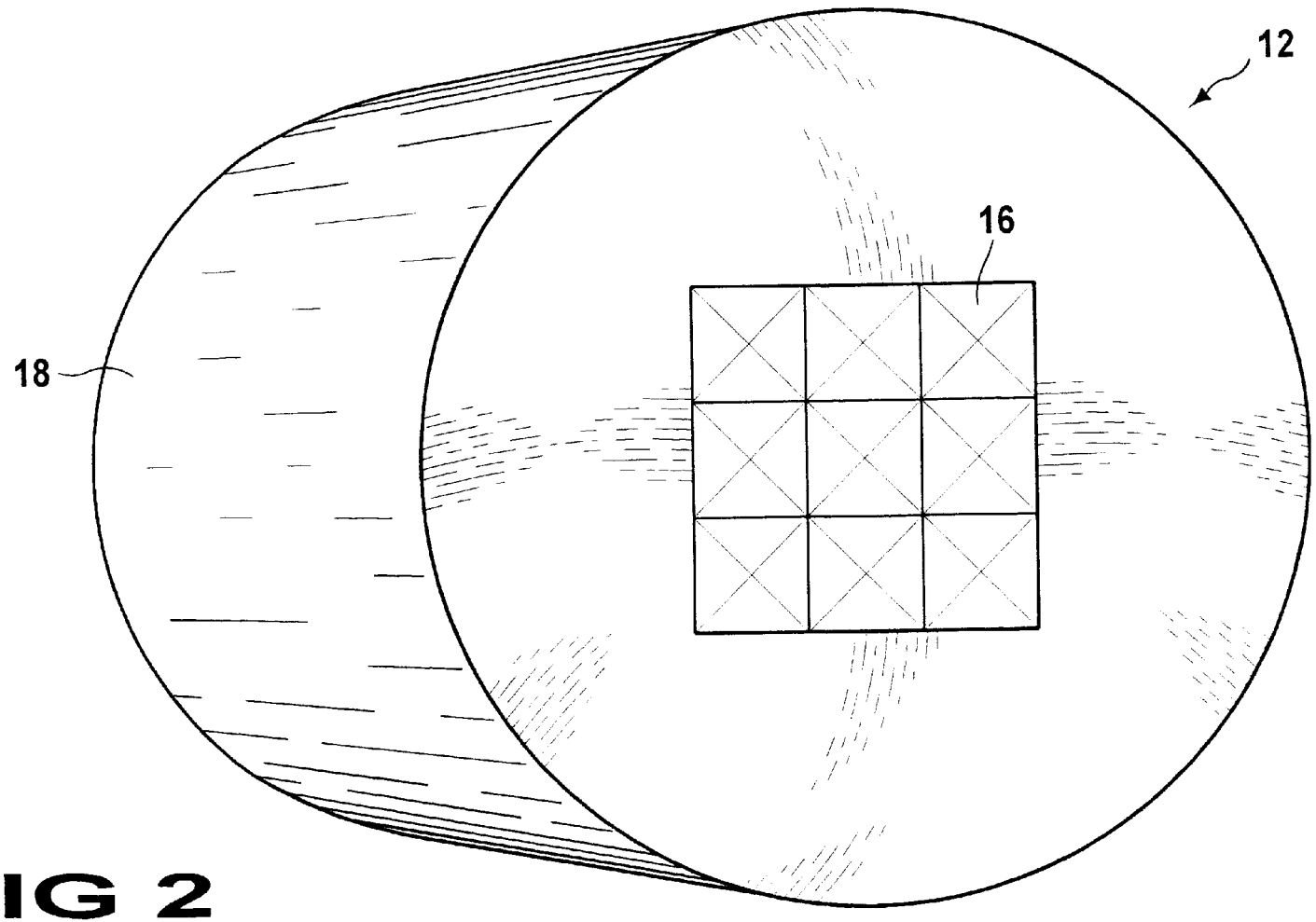
FIG. 2 is a top plan view showing the number of photo voltaic cells mounted thereon.

Turning to FIG. 2, therein is shown a top view of the cap 12 showing a number of photoelectric cells 16 arranged at or near the apex of the hat 12 so as to catch maximum sunlight. Also shown is the brim 18 of the cap 12.

Figure 3:
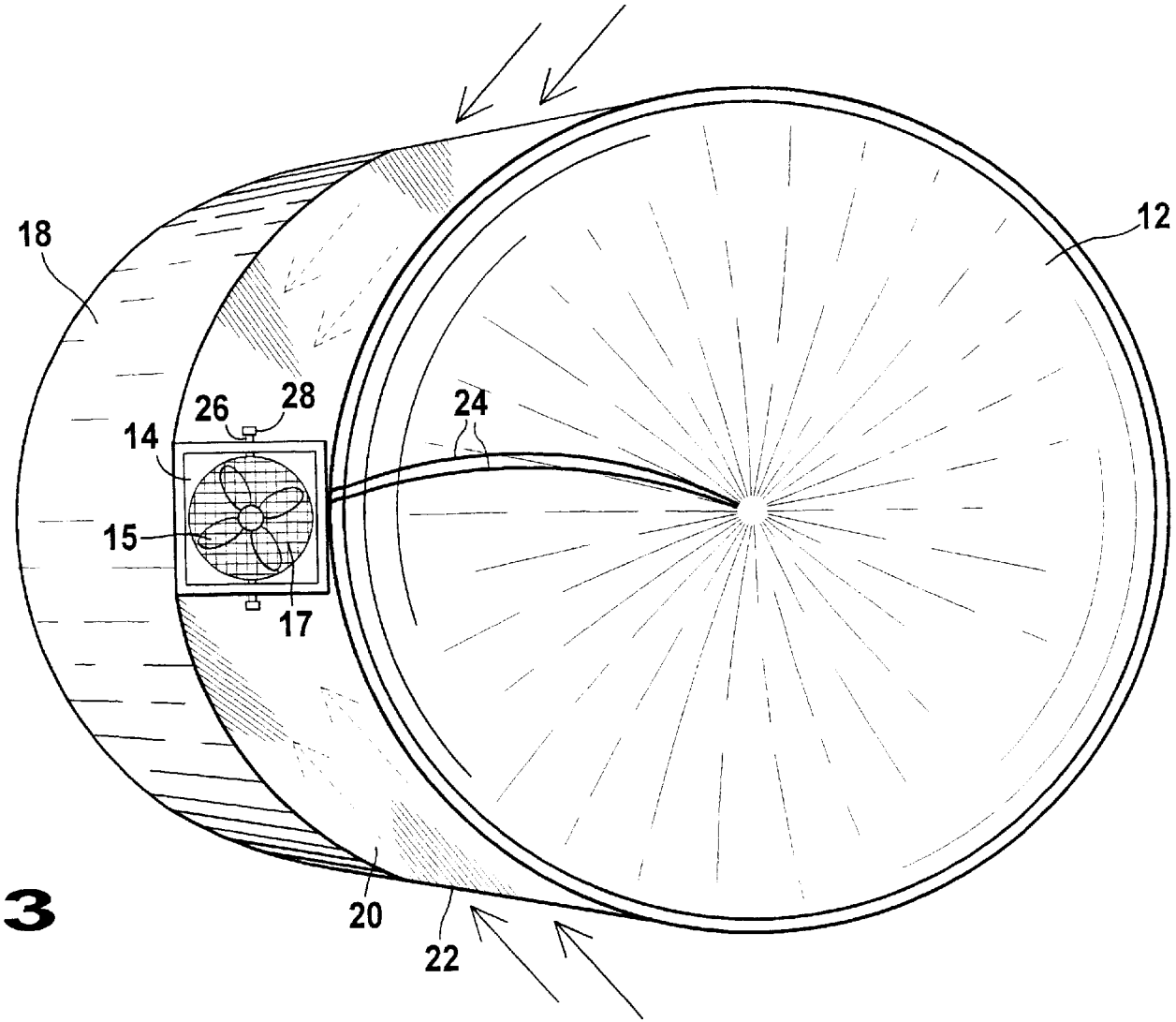
FIG. 3 is a bottom view of the preferred embodiment of the present invention showing a pair of wires which delivers the electricity needed to power the fan from the photo voltaic cells. Also shown is conduit located along the brim of the hat which will bring an amount of air to the fan which has means for directing an air flow either towards the face or away from the face.

Turning to FIG. 3, therein is shown a bottom view of the cap 12 along with the preferred embodiment of the present invention 10. Therein is shown a pair of wires 24 of the standard type which are contiguous with the inner surface of the top of the hat 12 which transmit the electricity needed to power the fan 14 from the photoelectric cells (not shown). Also shown is the conduit 20 located along and under the brim 18 of the hat 12 which will bring an effective amount of fresh air to the fan 14 by having inlet means 22. The conduit 20 extends laterally from the fan 14 running entirely from side to side of the brim and furthermore extends to about the midpoint between the front edge of the brim and the front headband of the hat. The fan also has mounting means 26 for attachment to the brim 18 along with control knobs 28 which mounting means allow the fan to rotate partially in the horizontal plane for directing air flow either towards the face of the user or away from the face of the user. Also shown are the fan blades 15 along with a screen or filter 17 for removing particulate matter from the air stream.

Turning to FIG. 4, therein is shown an exploded view of the present invention 10 which directs air flow to the facial area of the head of the user. Shown is a portion of the length of the conduit 20 which brings an effective amount of fresh air from the side of the brim 18 where the air inlet 22 of the conduit 20 is located and delivers said air by means of the impeller (not shown) of the fan 14 to the front of the head of the user wherein it may be selectably directed in the horizontal plane by means of the fan 14 being mounted on an axle 26. This allows the user to direct air which contains an undesirable amount of airborne particles such as dust and dirt away from the face of the user and uses the flow of air to prohibit the airborne particles from entering the front of the area of the head of the user. The conduit 20 having fresh air inlet 22 acts in concert with the fan 14 to keep any airborne particles away from the eyes of the wearer. The fan screen (not shown) also acts to provide fresh air to the face of the user.

Turning to FIG. 5, therein is shown a bottom plan view of an alternate embodiment of the present invention 10. The components of the cooling apparatus are contained within a modular partially encircling or head engaging frame apparatus shown generally at 30 which can be attached to any favorite cap without modification of the cap and the apparatus 30 has slidable male 31 and female 33 means of adjustment 32 wherein said apparatus can be slidably adjusted in the standard way to fit the required hat size. Therein is shown a pair of fans 14 each being attached to the semi-flexible head engaging apparatus 30 whereby the frame 30 is attachable to any hat (not shown). The fans 14 each have a mounting axis 26 with control knobs 28 with other features as previously described. The head frame 30 is hollow providing an internal conduit for transmission of air through the frame 30 which acts as the conduit having multiple air inlet ports 34 to the frame 30 and opening onto the underside of the frame 30. Also shown are the photoelectric cells 16 having wires 24 so that the photoelectric cells 16 can be attached to the hat (not shown) of the user.

Turning to FIG. 6, therein is shown a top plan view of the frame 30 of the alternative embodiment of the present invention showing an amount of hook and loop material 36 located on the top surface at or near the front ends of the frame 30 which can be used to attach the frame 30 of the alternative embodiment to the underside of the brim of the cap (not shown). Also shown is the hook and loop material 36 on the photovoltaic cells which is likewise mounted onto the hat along with wires 24 and frame adjustment means 32.

Turning to FIG. 7, therein is shown a side perspective view of the cap 12 showing the hook and loop means 36 on the frame 30 for attaching the alternative cooling apparatus to an existing cap by attaching an amount of hook and loop material 38 to the outer edges of the underside of the brim 18 of the cap 12 which will hold the alternative embodiment to the cap. Also shown therein is the frame 30 which attaches to the bottom of the brim 18 of the hat 12 and partially encircles the head and hat of the user and the hook and loop material 40 attached to the hat shown whereby the photoelectric cells 16 can be attached to the hat 12 along with the wires 24. All of the hook and loop material can be of the peel and stick standard type.

What is claimed is new and desired to be protected by Letters Patent is set forth in the claims:

1. An apparatus for providing air to the face of the user, comprising:

(a) a hat sized for use by humans;

(b) said hat having a brim located on its front portion;

(c) a fan means having mounting means for attachment to the underside of said brim of said hat;

(d) said hat having photoelectric cell means attached near the apex of the top of said hat so as to gather sunlight and thereby generate electricity;

(e) means for transmitting electricity from said photoelectric cell means to said fan means whereby said fan means could operate;

(f) said fan means having air conduit means attached to the underside of said brim;

(g) a mounting means for attaching said conduit to the underside of said brim;

(h) said fan means having mounting means for communicating with said conduit means; and, (i) said air conduit means having air inlet means located near the lateral edges of said brim whereby air is supplied to the face of the user by said fan means.

2. The apparatus of claim 1, further comprising said fan mounting means having rotatable axis means so that said fan means is partially rotatable in the horizontal plane whereby fresh air can be provided to the face of the user.

3. The apparatus of claim 1, wherein said photoelectric cell means further comprise multiple cell means.

4. The apparatus of claim 1, wherein said means for transmitting electricity from said photoelectric cell means to said fan means further comprises electrical wire.

* * * * *